US006905353B2

(12) United States Patent
Ma et al.

(10) Patent No.: US 6,905,353 B2
(45) Date of Patent: Jun. 14, 2005

(54) ELECTRICAL CONNECTOR ASSEMBLY WITH PICK UP CAP PROTECTING CONTACTS

(75) Inventors: Hao-Yun Ma, Tu-chen (TW); Ming-Lun Szu, Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/618,147

(22) Filed: Jul. 11, 2003

(65) Prior Publication Data

US 2004/0175974 A1 Sep. 9, 2004

(30) Foreign Application Priority Data

Mar. 7, 2003 (TW) ..... 92203517 U

(51) Int. Cl.[7] ..... H01R 13/44
(52) U.S. Cl. ..... 439/135; 439/41; 439/940
(58) Field of Search ..... 439/135, 41, 342, 439/940

(56) References Cited

U.S. PATENT DOCUMENTS

| | | | | | |
|---|---|---|---|---|---|
| 5,688,133 | A | * | 11/1997 | Ikesugi et al. | 439/135 |
| 5,819,404 | A | | 10/1998 | Whiting | 24/843 |
| 6,019,617 | A | * | 2/2000 | Liu et al. | 439/135 |
| 6,155,848 | A | * | 12/2000 | Lin | 439/135 |
| 6,413,111 | B1 | | 7/2002 | Pickles et al. | 439/342 |
| 6,439,901 | B1 | * | 8/2002 | Ji et al. | 439/135 |
| 6,478,558 | B2 | | 11/2002 | Yamanaka et al. | 418/66 |
| 6,478,588 | B1 | * | 11/2002 | Howell et al. | 439/135 |
| 6,533,592 | B1 | | 3/2003 | Chen et al. | 439/35 |
| 6,547,609 | B2 | | 4/2003 | Howell et al. | 439/940 |
| 6,554,624 | B1 | * | 4/2003 | Yu | 439/135 |
| 6,561,825 | B1 | * | 5/2003 | McHugh et al. | 439/135 |
| 6,572,383 | B1 | | 6/2003 | Yu | 439/41 |
| 6,626,691 | B2 | * | 9/2003 | Yu | 439/342 |
| 6,655,970 | B2 | * | 12/2003 | Tsai | 439/135 |
| 2003/0027439 | A1 | * | 2/2003 | Johnescu et al. | 439/74 |
| 2003/0194891 | A1 | * | 10/2003 | Lin et al. | 439/135 |

* cited by examiner

*Primary Examiner*—Michael C. Zarroli
(74) *Attorney, Agent, or Firm*—Wei Te Chung

(57) ABSTRACT

An electrical connector assembly includes an electrical connector (2) and a pick up cap (1) attached onto the connector. The connector includes a generally rectangular housing (21), a clip (24) pivotally engaged to the housing, and a number of electrical contacts (23) received in the housing. The housing includes a cavity (210) formed with a front side (211), a rear side (212) opposite to the front side, and a pair of opposite lateral sides (213) interconnecting the front side and the rear side. The pick up cap includes a planar body (10) with a smooth top surface (100) and a bottom surface thereof. In use, the pick up cap is mounted between the clip and the housing, therefore, it is close to the contacts and covers nearly all the exposed contacts, thereby providing the protection of the contacts.

17 Claims, 5 Drawing Sheets

ELECTRICAL CONNECTOR ASSEMBLY WITH PICK UP CAP PROTECTING CONTACTS

BACKGROUND OF THE INVENTION

1. Field of the Invention

The present invention relates to an electrical connector assembly, and particularly to a combined pick up cap and electrical connector in which the pick up cap is attached onto the electrical connector.

2. Description of the Prior Art

On many production lines, electronic components such as electrical connectors are accurately positioned on a printed circuit board (PCB) such as a motherboard by means of a vacuum suction device. Since an electrical connector typically has a multiplicity of through holes in a top portion thereof, a pick up cap has to be pre-attached on the electrical connector. The vacuum suction device is then able to engage on a flat top surface of the pick up cap, in order to reliably move and accurately position the electrical connector onto the PCB. This kind of pick up cap is shown in U.S. Pat. No. 6,413,111 to Pickles et al., dated Apr. 6, 1993.

Commonly, a Land Grid Array (LGA) socket comprises a housing mounted on a printed circuit board, a metal clip pivotably engaged on the housing, and a plurality of contacts secured in the housing. The metal clip has a window in the center. Each contact protrudes a predetermined height above a surface of the housing to contact with a Land Grid Package (LGP), and the exposed portions of the contacts are liable to be distorted or even damaged when they are impacted by a foreign object.

On a production line, the metal clip of the conventional LGA socket is rotated downwardly to a horizontal closed position. A pick up cap is then attached on the metal clip. The pick up cap provides a smooth top surface for a vacuum suction device to engage. Thus the electrical connector can be moved and accurately positioned onto a predetermined location of the PCB.

However, one problem with this type of pick up cap is that it is attached on the clip is relatively far from the exposed portions of the contacts. Foreign matter, such as wires used on the assembly line or a finger of an operator, is liable to enter a space between the metal clip and the housing. The exposed portions of the contacts are liable to be damaged and/or contaminated by such foreign matter.

In view of the above, a new electrical connector assembly with a pick up cap which overcomes the above-mentioned disadvantages is desired.

SUMMARY OF THE INVENTION

Accordingly, an object of the present invention is to provide an electrical connector assembly having a pick up cap for providing a smooth top surface for a vacuum suction device, and for protecting contacts of an electrical connector of the electrical connector assembly.

To achieve the above-mentioned object, an electrical connector assembly in accordance with a preferred embodiment of the present invention comprises an electrical connector and a pick up cap attached onto the connector to provide a flat top surface for a vacuum suction device. The connector comprises a generally square insulative housing, a clip pivotally engaged to the housing, and a plurality of electrical contacts received in the housing. The housing comprises a front side, a rear side opposite to the front side, and a pair of opposite lateral sides interconnecting the front side and the rear side. The front side, rear side and lateral sides cooperatively define a cavity for receiving a central processing unit (CPU) therein. A bottom position of the housing under the cavity defines a multiplicity of passageways, the passageways receiving the contacts therein. A securing recess is defined in a middle portion of the front side, and a pair of spaced rear steps is defined in the rear side of the housing. A pair of spaced, rectangular lateral steps is formed in each lateral side of the housing.

The pick up cap comprises a planar body with a smooth top surface and a bottom surface thereof. The planar body comprises a head portion thereof corresponding to the securing recess of the housing, a pair of spaced tail portions at a rear edge thereof corresponding to the rear steps of the housing, and a pair of spaced lateral portions at each of opposite lateral sides thereof corresponding to respective lateral steps of the housing. A pair of spaced, parallel latch arms depends from a bottom surface of the head portion. In use, the pick up cap is mounted between the clip and the housing, therefore, it is close to the contacts and covers nearly all the exposed contacts, thereby providing effective protection for the contacts.

Other objects, advantages and novel features of the invention will become more apparent from the following detailed description when taken in conjunction with the accompanying drawings, in which:

DETAILED DESCRIPTION OF THE PREFERRED EMBODIMENT OF THE INVENTION

Reference will now be made to the drawings to describe the present invention in detail.

Figure 1:
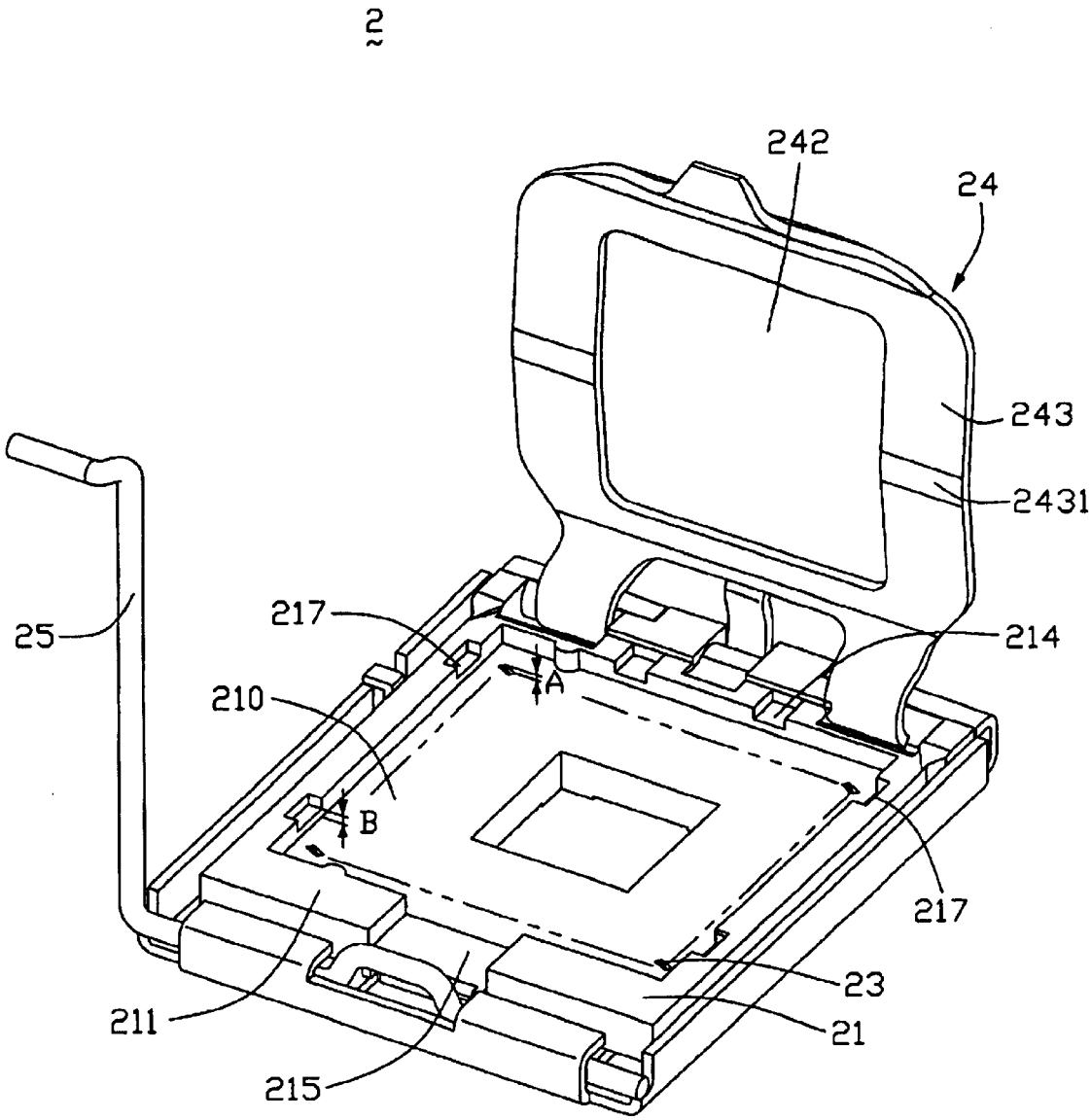
FIG. 1 is a simplified, isometric view of an electrical connector of the electrical connector assembly in accordance with the preferred embodiment of the present invention.
Figure 2:
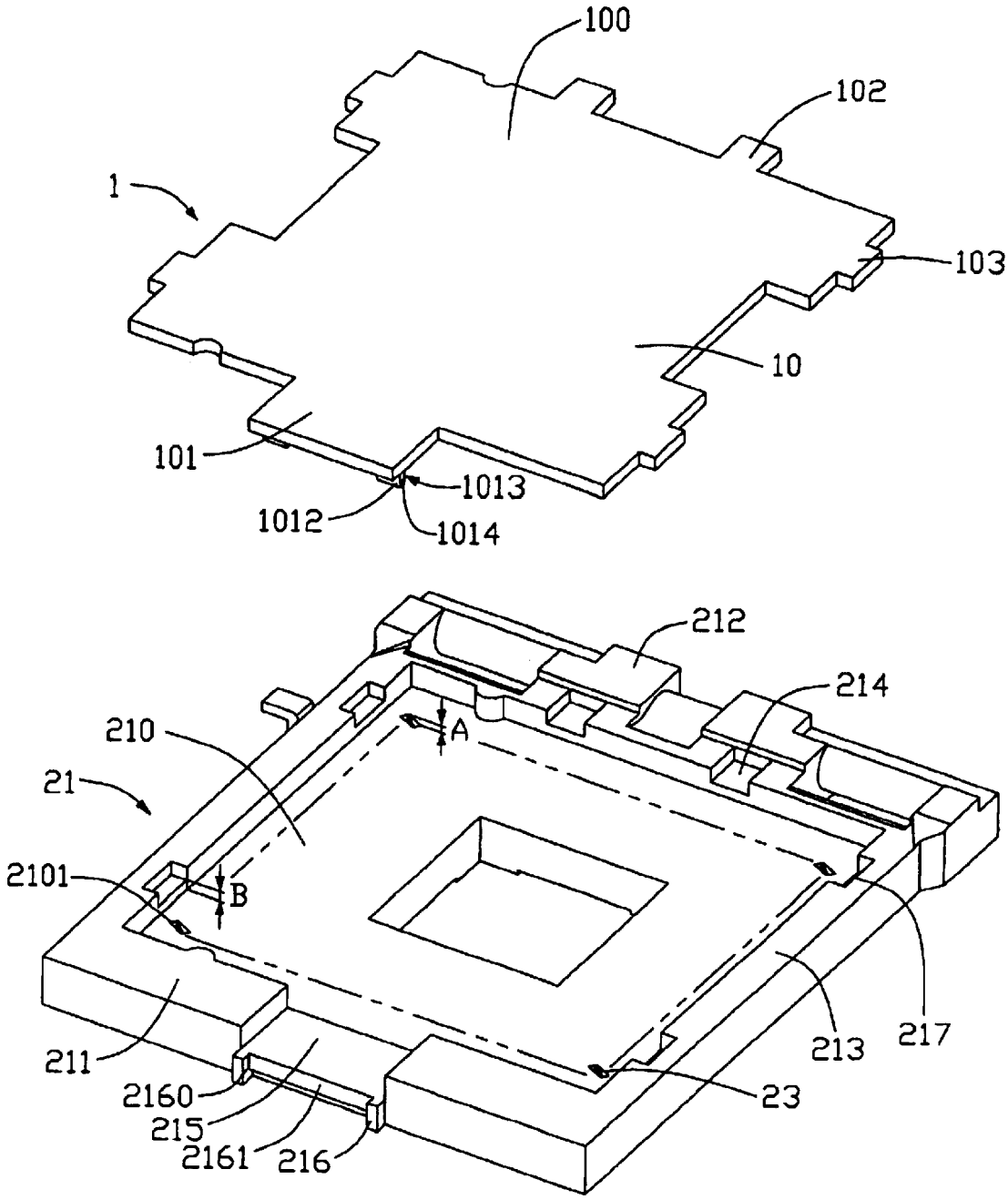
FIG. 2 is a simplified, exploded isometric view of a housing of the electrical connector of FIG. 1 and a pick up cap of the electrical connector assembly in accordance with the preferred embodiment of the present invention.

Referring to FIGS. 1–2, an electrical connector assembly of the present invention comprises an electrical connector 2 and a pick up cap 1. The electrical connector 2 comprises an insulative housing 21 grasped by a reinforcement metal frame (not labeled), a clip 24 pivotally attached to the housing 21, and a load lever 25 for pressing the clip 24 onto the housing 21. A plurality of contacts 23 is secured in the housing 21. The pick up cap 1 is attached onto the housing 21 to provide a flat top surface for the connector assembly, and to protect the contacts 23 of the electrical connector 2. The clip 24 defines a center window 242, and comprises two ribs 243 having two pressing portions 2431 respectively.

The housing 21 has a generally square configuration, and a plurality of electrical contacts 23 received therein. The housing 21 comprises a front side 211, a rear side 212 opposite to the front side 211, and a pair of opposite lateral sides 213 interconnecting the front side 211 and the rear side 212. The front side 211, rear side 212 and lateral sides 213 cooperatively define a generally rectangular cavity 210 therebetween for receiving a central processing unit (CPU) (not shown) therein. A bottom portion of the housing 21 under the cavity 210 defines a multiplicity of passageways 2101, the passageways 2101 receiving the contacts 23 therein. Each contact 23 protrudes a predetermined height A above said bottom portion of the housing 21, for contacting the CPU.

A securing recess 215 is defined in a middle portion of the front side 211 of the housing 21. A pair of engaging bars 216 extends forwardly from the front side 211 at opposite ends of the securing recess 215 respectively. Each engaging bar 216 comprises an inside first engaging surface 2160. A second engaging surface 2161 is defined on the front side 211 between the first engaging surfaces 2160.

A pair of spaced rear steps 214 is formed in the rear side 212 of the housing 21. A pair of spaced lateral steps 217 is formed in each lateral side 213 of the housing 21, adjacent the cavity 210. The securing recess 215, rear steps 214, and lateral steps 217 all define respective top surfaces, and the top surfaces being a same height B above said bottom portion of the housing 21. In the preferred embodiment of the invention, height B is slightly greater than height A.

The pick up cap 1 has a planar body 10 having a smooth top surface 100. The planar body 10 comprises a head portion 101 at a front thereof corresponding to the securing recess 215 of the housing 21, a pair of spaced tail portions 102 at a rear edge thereof corresponding to the rear steps 214 of the housing 21, and a pair of spaced lateral portions 103 at each of opposite lateral sides thereof corresponding to respective lateral steps 217 of the housing 21. A pair of spaced, parallel latch arms 1012 depends from a bottom of the head portion 101. Each latch arm 1012 comprises a main inner surface 1013 and an outer side edge 1014, corresponding to the second engaging surface 2161 and a respective first engaging surface 2160 of the housing 21, respectively.

Figure 3:
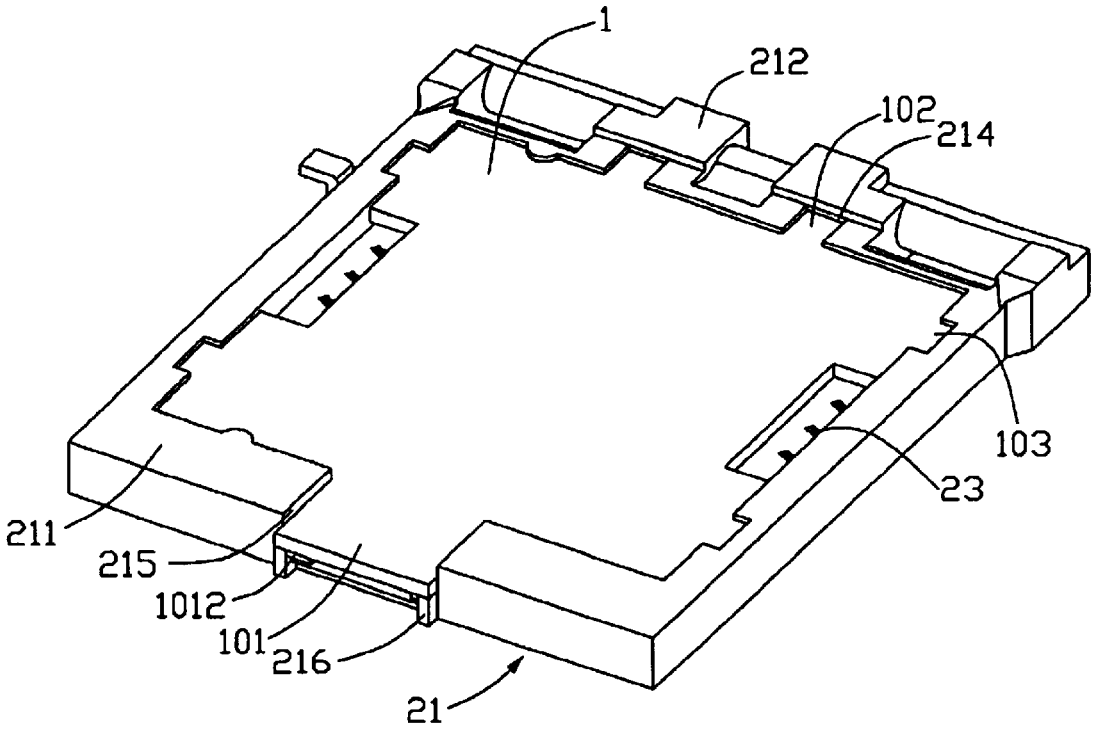
FIG. 3 is an assembled view of FIG. 2.
Figure 4:
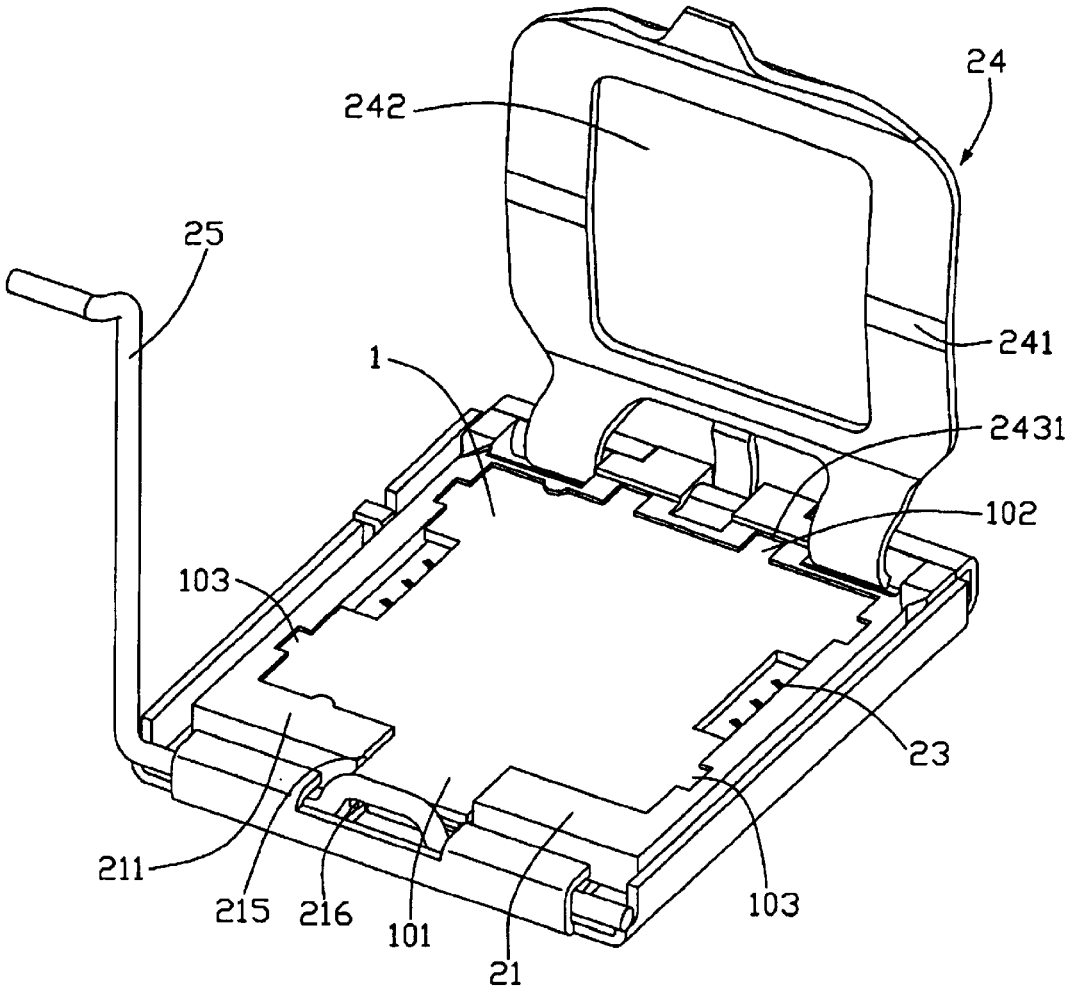
FIG. 4 is an isometric view of the electrical connector assembly in accordance with the preferred embodiment of the present invention, showing a metal clip thereof in an open position.

Referring also to FIGS. 3–4, in assembly, the clip 24 is rotated to a vertical open position. The pick up cap 1 is placed on the housing 21, and pressed downwardly. The tail portions 102 of the pick up cap 1 are supported on the rear steps 214 of the rear side 212, and the inner surfaces 1013 of the latch arms 1012 loosely contact a top edge portion of the second engaging surface 2161.

A front of the pick up cap 1 is pressed downwardly, and the latch arms 1012 deflect outwardly as they ride over said top edge portion. The bottom of the head portion 101 is attached on a top surface of the front side 211 in the securing recess 215, with the lateral portions 103 fittingly attached on the corresponding lateral steps 217, and the tail portions 102 fittingly attached on the corresponding rear steps 220. That is, the pick up cap 1 is supported by top surfaces of the housing 21 in the securing recesses 215, the rear steps 220, and the lateral steps 217. The inner surfaces 1013 of the latch arms 1012 resiliently abut against the second engaging surface 2161. The side edges 1014 of the latch arms 1012 fittingly abut the first engaging surfaces 2160. Thus, the pick up cap 1 is securely fastened on the connector 2. Because the distance B is greater than the distance A, the pick up cap 1 does not contact or press the exposed contacts 23. Rather, the pick up cap 1 protects the contacts 23 from being damaged or contaminated.

In use, the clip 24 is rotated to a horizontal closed position, and is fastened to the housing 21 by the load lever 25. The top surface of the pick up cap 1 faces the center window 242 of the clip 24. A vacuum suction device can pass through the center window 242 and engage on the top surface 100 of the pick up cap 1, for moving of the connector assembly to a desired location.

Figure 5:
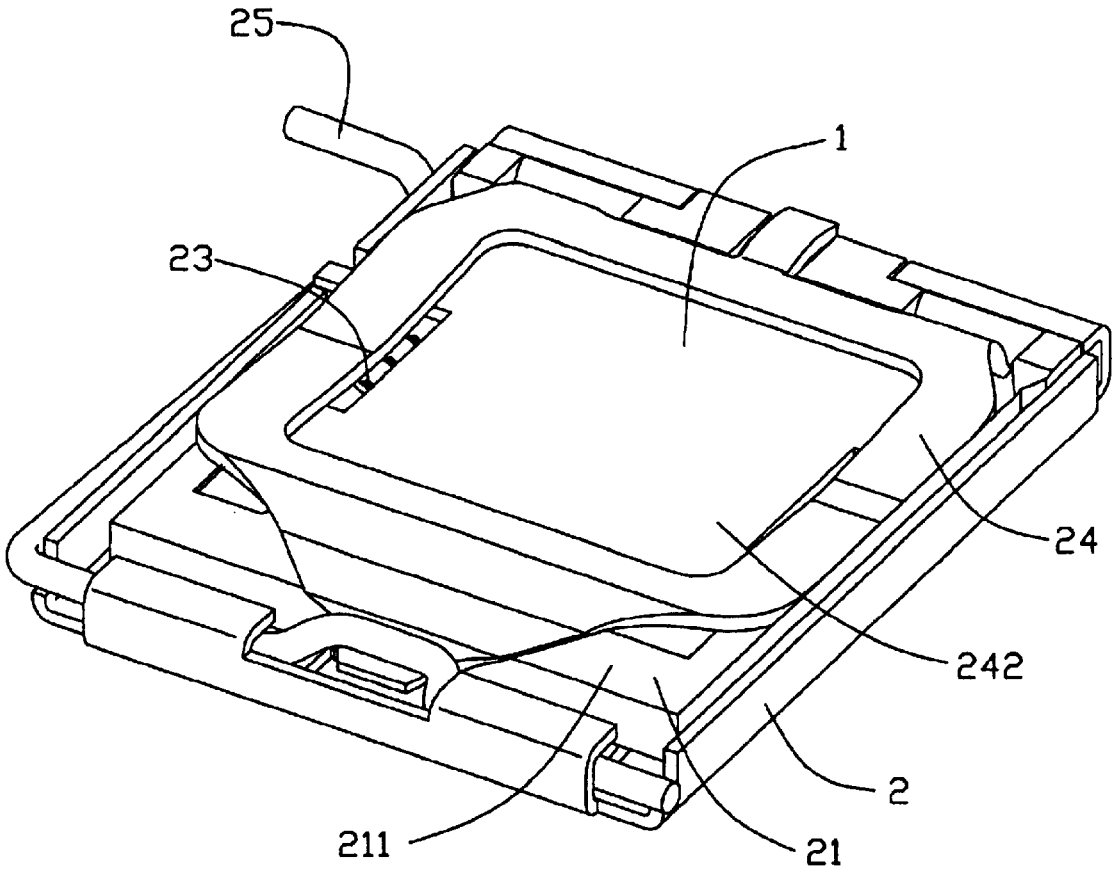
FIG. 5 is similar to FIG. 4, but showing the metal clip in a closed position.

As shown in FIG. 5, the pick up cap 1 is disposed between the housing 21 and the clip 24. The pick up cap 1 is close to the exposed contacts 23, thereby providing effective protection for the contacts 23.

While a preferred embodiment in accordance with the present invention has been shown and described, equivalent modifications and changes known to persons skilled in the art according to the spirit of the present invention are considered within the scope of the present invention as defined in the appended claims.

What is claimed is:

1. An electrical connector assembly comprising:

an electrical connector comprising an insulative housing, a clip engaged on the housing, and a plurality of electrical contacts received in the housing, the contacts protruding from the housing;

a pick up cap engaged on the housing and comprising a planar body with a smooth top surface for being sucked by a vacuum suction device and covering at least a portion of the contacts;

wherein the pick up cap is disposed between the housing and the clip;

whereby the pick up cap protects the contacts from damage or contamination.

2. The electrical connector assembly as claimed in claim 1, wherein the housing comprises a bottom portion, a front side, a rear side, and a pair of lateral sides cooperatively defining a cavity therebetween.

3. The electrical connector assembly as claimed in claim 2, claim 2, wherein the electrical contacts protrude a predetermined height above a bottom portion of the housing in the cavity.

4. The electrical connector assembly as claimed in claim 2, wherein a securing recess is defined in the front side, a plurality of spaced rear steps is provided in the rear side, and a plurality of spaced steps is provided in each lateral side.

5. The electrical connector assembly as claimed in claim 4, wherein the securing recess, the lateral steps and the rear steps define a same height, and said height is greater than said predetermined height of the contacts protruding above the bottom portion of the housing.

6. The electrical connector assembly as claimed in claim 1, wherein the pick up cap comprises a head portion, a plurality of spaced tail portions, and a plurality of spaced lateral portions.

7. The electrical connector assembly as claimed in claim 6, wherein a pair of spaced, parallel latch arms depends from the head portion.

8. The electrical connector assembly as claimed in claim 1, wherein the clip defines a center window.

9. An electrical connector assembly comprising:

an electrical connector comprising a dielectric housing, and a plurality of conductive contacts received therein, the housing comprising a plurality of side walls and a bottom portion cooperatively defining a cavity therebetween; and a pick up cap comprising a planar body with a smooth top surface; wherein the pick up cap is disposed in the cavity and engages with sidewalls of the cavity;

whereby the pickup cap provides protection for the contacts, and the side walls of the housing are comprised in a front side, a rear side and a pair of lateral sides of the housing, and a securing recess is defined in the front side, a pair of spaced rear steps is provided in the rear side, and a pair of spaced lateral steps is provided in each lateral side.

10. The electrical connector assembly as claimed in claim 9, wherein the contacts protrude a predetermined height above a bottom portion of the housing in the cavity.

11. The electrical connector assembly as claimed in claim 9, wherein the securing recess, the lateral steps and the rear steps define a same height, and said same height is greater than said predetermined height of the contacts protruding above the bottom of the housing.

12. The electrical connector assembly as claimed in claim 9, wherein the pick up cap comprises a head portion, a pair of spaced tail portions, and a plurality of spaced lateral portions.

13. The electrical connector assembly as claimed in claim 12, wherein a pair of spaced, parallel latch arms depends from the head portion.

14. An electrical connector assembly comprising:

a housing assembly defining an upper face thereon;

a plurality of contacts disposed in the housing assembly;

a pick up cap mounted upon the upper face and defining an upward top surface thereon; and a moveable fastening device attached to the housing assembly and defining an opening; wherein the fastening device is moved to either an open position to allow the pick up cap to be downwardly seated upon the housing, or a closed position to cooperate with the housing assembly to sandwich the pick up cap therebetween for holding the pick up cap in position without upward withdrawal under a condition that said opening exposes the upward top surface of said pick up cap to an exterior in a vertical direction for suction.

15. The assembly as claimed in claim 14, wherein said housing assembly includes a reinforcement metal frame.

16. An electrical connector assembly comprising:

an insulative housing assembly defining an upper face thereon;

a plurality of contacts disposed in the housing assembly with upper contact portions extending upwardly above the upper face with a first distance; and a pick up cap mounted upon the upper face and defining an planar body with an upward top surface thereon; wherein an undersurface of said planar body is spaced from said upper face with a second distance which is slightly larger than said first distance so as to protectively have said upper contact portion closely hidden under said planar body without damage during handing.

17. The assembly as claimed in claim 16, wherein said contacts are arranged in matrix, and said pick up cap encloses substantially all of said contacts.

* * * * *

US006905353C1

(12) EX PARTE REEXAMINATION CERTIFICATE (9219th)

United States Patent
Ma et al.

(10) Number: US 6,905,353 C1
(45) Certificate Issued: Aug. 21, 2012

(54) ELECTRICAL CONNECTOR ASSEMBLY WITH PICK UP CAP PROTECTING CONTACTS

(75) Inventors: Hao-Yun Ma, Tu-chen (TW); Ming-Lun Szu, Tu-Chen (TW)

(73) Assignee: Hon Hai Precision Ind. Co., Ltd., Tu-Chen, Taipei Hsien (TW)

Reexamination Request:
No. 90/009,928, Jul. 25, 2011

Reexamination Certificate for:

| | |
|---|---|
| Patent No.: | **6,905,353** |
| Issued: | **Jun. 14, 2005** |
| Appl. No.: | **10/618,147** |
| Filed: | **Jul. 11, 2003** |

(30) Foreign Application Priority Data

Mar. 7, 2003 (TW) ..... 92203517 U

(51) Int. Cl.
*H01R 13/44* (2006.01)

(52) U.S. Cl. ..... 439/135; 439/41; 439/940

(58) Field of Classification Search ..... None
See application file for complete search history.

(56) References Cited

To view the complete listing of prior art documents cited during the proceeding for Reexamination Control Number 90/009,928, please refer to the USPTO's public Patent Application Information Retrieval (PAIR) system under the Display References tab.

*Primary Examiner*—Stephen Ralis

(57) ABSTRACT

An electrical connector assembly includes an electrical connector (2) and a pick up cap (1) attached onto the connector. The connector includes a generally rectangular housing (21), a clip (24) pivotally engaged to the housing, and a number of electrical contacts (23) received in the housing. The housing includes a cavity (210) formed with a front side (211), a rear side (212) opposite to the front side, and a pair of opposite lateral sides (213) interconnecting the front side and the rear side. The pick up cap includes a planar body (10) with a smooth top surface (100) and a bottom surface thereof. In use, the pick up cap is mounted between the clip and the housing, therefore, it is close to the contacts and covers nearly all the exposed contacts, thereby providing the protection of the contacts.

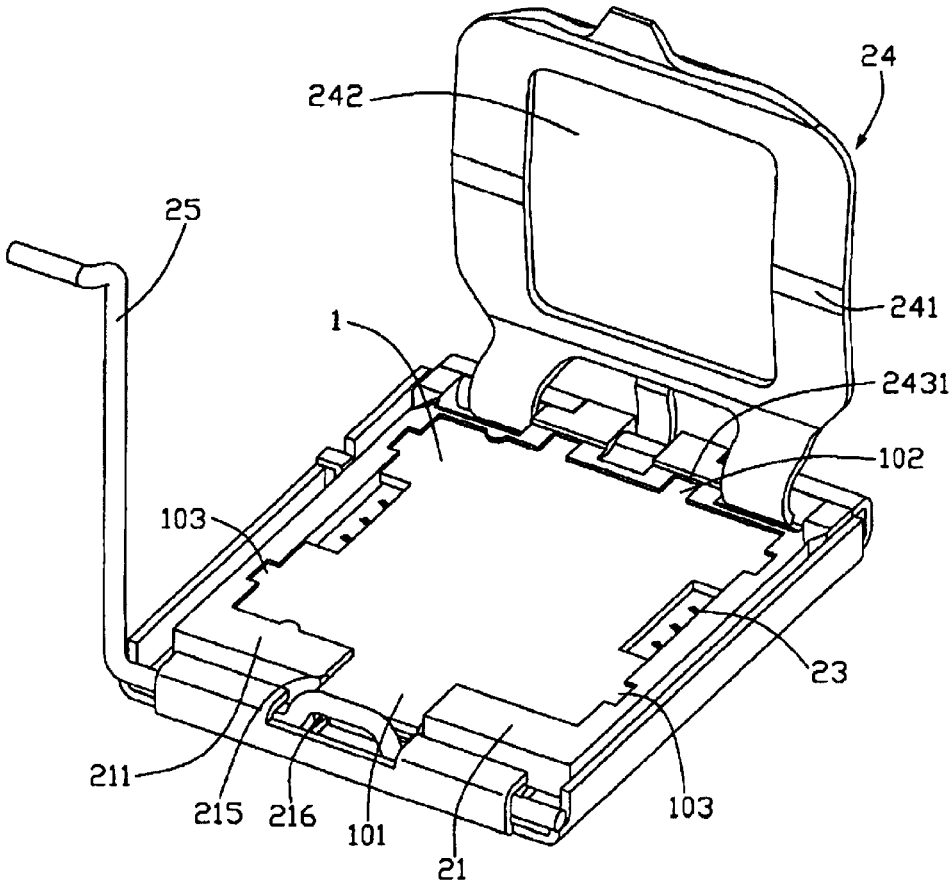

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1, 3, 9, 14, 16 and 17 are determined to be patentable as amended.

Claims 2, 4-8, 10-13 and 15, dependent on an amended claim, are determined to be patentable.

New claims 18-47 are added and determined to be patentable.

1. An electrical connector assembly comprising:

an electrical connector comprising an insulative housing, a clip engaged on the housing, and a plurality of electrical contacts received in the housing, the contacts protruding from the housing;

a pick up can engaged on *an upper surface* of the housing *without physically engaging any contacts* and comprising a planar body with a smooth top surface for being sucked by a vacuum suction device and covering at least a portion of the contacts;

wherein the pick up cap is disposed between the housing and the clip; whereby the pick up cap protects the contacts from damage or contamination.

3. The electrical connector assembly as claimed in claim 2, [claim 2,] wherein the electrical contacts protrude a predetermined height above a bottom portion of the housing in the cavity.

9. An electrical connector assembly comprising:

an electrical connector comprising a dielectric housing *with an upper face*, and a plurality of conductive contacts received therein, the housing comprising a plurality of side walls and a bottom portion cooperatively defining a cavity therebetween; and a pick up cap comprising a planar body with a smooth top surface; wherein the pick up cap is disposed in the cavity and engages with sidewalls of the cavity *and the upper face of the housing without physically engaging any contacts*;

whereby the pickup cap provides protection for the contacts, and the side walls of the housing are comprised in a front side, a rear side and a pair of lateral sides of the housing, and a securing recess is defined in the front side, a pair of spaced rear steps is provided in the rear side, and a pair of spaced lateral steps is provided in each lateral side.

14. An electrical connector assembly comprising:

a housing assembly defining an upper face thereon;

a plurality of contacts disposed in the housing assembly;

a pick up cap mounted upon the upper face *without physically engaging any contacts* and defining an upward top surface thereon; and a moveable fastening device attached to the housing assembly and defining an opening;

wherein the fastening device is moved to either an open position to allow the pick up cap to be downwardly seated upon the housing, or a closed position to cooperate with the housing assembly to sandwich the pick up cap therebetween for holding the pick up cap in position without upward withdrawal under a condition that said opening exposes the upward top surface of said pick up cap to an exterior in a vertical direction for suction.

16. An electrical connector assembly comprising:

an insulative housing assembly defining an upper face thereon;

a plurality of contacts disposed in the housing assembly with upper contact portions extending upwardly above the upper face with a first distance; and a pick up cap mounted upon the upper face *without physically engaging any contacts* and defining [an] *a* planar body with an upward top surface thereon;

wherein an undersurface of said planar body is spaced from said upper face with a second distance which is slightly larger than said first distance so as to protectively have said upper contact portion closely hidden under said planar body without damage during handing.

17. The assembly as claimed in claim 16, wherein said contacts are arranged in *a* matrix, and said pick up cap encloses substantially all of said contacts.

*18. An electrical connector assembly for mounting on a printed circuit board and for coupling a land grid package to said printed circuit board, said connector assembly comprising:*

*an electrical connector comprising an insulative housing, a clip engaged on the housing that is moveable from an open position to a closed position, and a plurality of electrical contacts received in the housing for providing a conduction path between said printed circuit board and said land grid package when said land grid package is installed on said electrical connector assembly, the contacts protruding from the housing;*

*a pick up cap engaged on an upper face of the housing without physically engaging any contacts and comprising a planar body with a smooth top surface for being sucked by a vacuum suction device and covering at least a portion of the contacts;*

*wherein the pick up cap is disposed between the housing and the clip; whereby the pick up cap protects the contacts from damage or contamination.*

*19. The electrical connector assembly as claimed in claim 18, wherein the housing comprises a bottom portion, a front side, a rear side, and a pair of lateral sides cooperatively defining a cavity therebetween.*

*20. The electrical connector assembly as claimed in claim 19, wherein the electrical contacts protrude a predetermined height above a bottom portion of the housing in the cavity.*

*21. The electrical connector assembly as claimed in claim 19, wherein a securing recess is defined in the front side, a plurality of spaced rear steps is provided in the rear side, and a plurality of spaced steps is provided in each lateral side.*

*22. The electrical connector assembly as claimed in claim 21, wherein the securing recess, the lateral steps and the rear steps define a same height, and said height is greater than said predetermined height of the contacts protruding above the bottom portion of the housing.*

*23. The electrical connector assembly as claimed in claim 18, wherein the pick up cap comprises a head portion, a plurality of spaced tail portions, and a plurality of spaced lateral portions.*

*24. The electrical connector assembly as claimed in claim 23, wherein a pair of spaced, parallel latch arms depends from the head portion.*

*25. The electrical connector assembly as claimed in claim 18, wherein the clip defines a center window.*

*26. An electrical connector assembly for mounting on a printed circuit board and for coupling a land grid package to said printed circuit board, said electrical connector assembly comprising:*

*an electrical connector comprising a dielectric housing, and a plurality of conductive contacts received therein, the conductive contacts for providing a conduction path between said printed circuit board and said land grid package when said land grid package is installed on said electrical connector assembly, the housing comprising a plurality of side walls and a bottom portion cooperatively defining a cavity therebetween;*

*and a pick up cap comprising a planar body with a smooth top surface;*

*wherein the pick up cap is disposed in the cavity and engages an upper face of the housing with sidewalls of the cavity without physically engaging any contacts; whereby the pickup cap provides protection for the contacts, and the side walls of the housing are comprised in a front side, a rear side and a pair of lateral sides of the housing ,and a securing recess is defined in the front side, a pair of spaced rear steps is provided in the rear side, and a pair of spaced lateral steps is provided in each lateral side.*

*27. The electrical connector assembly as claimed in claim 26, wherein the contacts protrude a predetermined height above a bottom portion of the housing in the cavity.*

*28. The electrical connector assembly as claimed in claim 26, wherein the securing recess, the lateral steps and the rear steps define a same height, and said same height is greater than said predetermined height of the contacts protruding above the bottom of the housing.*

*29. The electrical connector assembly as claimed in claim 26, wherein the pick up cap comprises a head portion, a pair of spaced tail portions, and a plurality of spaced lateral portions.*

*30. The electrical connector assembly as claimed in claim 29, wherein a pair of spaced, parallel latch arms depends from the head portion.*

*31. An electrical connector assembly for mounting on a printed circuit board and for coupling a land grid package to said printed circuit board, said electrical connector assembly comprising:*

*a housing assembly defining an upper face thereon; a plurality of contacts disposed in the housing assembly, the contacts for providing a conduction path between said printed circuit board and said land grid package when said land grid package is installed on said electrical connector assembly;*

*a pick up cap mounted upon the upper face without physically engaging any contacts and defining an upward top surface thereon; and*

*a moveable fastening device attached to the housing assembly and defining an opening;*

*wherein the fastening device is moved to either an open position to allow the pick up cap to be downwardly seated upon the housing, or a closed position to cooperate with the housing assembly to sandwich the pick up cap therebetween for holding the pick up cap in position without upward withdrawal under a condition that said opening exposes the upward top surface of said pick up cap to an exterior in a vertical direction for suction.*

*32. The assembly as claimed in claim 31, wherein said housing assembly includes a reinforcement metal frame.*

*33. An electrical connector assembly for mounting on a printed circuit board and for coupling a land grid package to said printed circuit board, said electrical connector assembly comprising:*

*an insulative housing assembly defining an upper face thereon;*

*a plurality of contacts disposed in the housing assembly with upper contact portions extending upwardly above the upper face with a first distance, the contacts for providing a conduction path between said printed circuit board and said land grid package when said land grid package is installed on said electrical connector assembly; and*

*a pick up cap mounted upon the upper face without physically engaging any contacts and defining an planar body with an upward top surface thereon;*

*wherein an undersurface of said planar body is spaced from said upper face with a second distance which is slightly larger than said first distance so as to protectively have said upper contact portion closely hidden under said planar body without damage during handing.*

*34. The assembly as claimed in claim 33, wherein said contacts are arranged in matrix, and said pick up cap encloses substantially all of said contacts.*

*35. An electrical connector assembly for mounting on a printed circuit board and for coupling a land grid package to said printed circuit board, said electrical connector assembly comprising:*

*an insulative housing assembly defining an upper face thereon;*

*a plurality of contacts disposed in the housing assembly with upper contact portions extending upwardly above the upper face with a first distance, the contacts for providing a conduction path between said printed circuit board and said land grid package when said land grid package is installed on said electrical connector assembly; and*

*a pick up cap mounted upon the upper face without physically engaging any contacts and defining an planar body with an upward top surface thereon for use with a vacuum suction device when moving said electrical connector assembly to a desired location on said printed circuit board;*

*wherein an undersurface of said planar body is spaced from said upper face with a second distance which is slightly larger than said first distance so as to protectively have said upper contact portion closely hidden under said planar body without damage during handing.*

*36. An electrical connector assembly comprising:*

*an electrical connector comprising an insulative housing, a clip pivotably engaged on the housing that is pivotable from an open position to a closed position and defining an opening, and a plurality of electrical contacts received in the housing, the contacts protruding from the housing;*

*a pick up cap engaged on an upper face of the housing without physically engaging any contacts and compris-*

*ing a planar body with a smooth top surface for being sucked by a vacuum suction device and covering at least a portion of the contacts, the opening in the clip exposing the top surface of the pick up cap to an exterior in a vertical direction for suction;*

*wherein the pick up cap is disposed between the housing and the clip; whereby the pick up cap protects the contacts from damage or contamination.*

*37. The electrical connector assembly as claimed in claim 36, wherein the housing comprises a bottom portion, a front side, a rear side, and a pair of lateral sides cooperatively defining a cavity therebetween.*

*38. The electrical connector assembly as claimed in claim 37, wherein the electrical contacts protrude a predetermined height above a bottom portion of the housing in the cavity.*

*39. The electrical connector assembly as claimed in claim 37, wherein a securing recess is defined in the front side, a plurality of spaced rear steps is provided in the rear side, and a plurality of spaced steps is provided in each lateral side.*

*40. The electrical connector assembly as claimed in claim 39, wherein the securing recess, the lateral steps and the rear steps define a same height, and said height is greater than said predetermined height of the contacts protruding above the bottom portion of the housing.*

*41. The electrical connector assembly as claimed in claim 36, wherein the pick up cap comprises a head portion, a plurality of spaced tail portions, and a plurality of spaced lateral portions.*

*42. The electrical connector assembly as claimed in claim 41, wherein a pair of spaced, parallel latch arms depends from the head portion.*

*43. The electrical connector assembly as claimed in claim 36, wherein the clip defines a center window.*

*44. An electrical connector assembly comprising:*

*a housing assembly defining an upper face thereon; a plurality of contacts disposed in the housing assembly;*

*a pick up cap mounted upon the upper face without physically engaging any contacts and defining an upward top surface thereon; and*

*a moveable fastening device attached to the housing assembly and defining an opening;*

*wherein the fastening device is moved to either an open positon to allow the pick up cap to be downwardly seated upon the housing or a closed position to cooperate with the housing assembly to sandwich the pick up cap therebetween for holding the pick up cap in position without upward withdrawal under a condition that said opening exposes the upward top surface of said pick up cap to an exterior in a vertical direction for suction.*

*45. The assembly as claimed in claim 44, wherein said housing assembly includes a reinforcement metal frame.*

*46. An electrical connector assembly comprising:*

*an insulative housing assembly defining an upper face thereon;*

*a plurality of contacts disposed in the housing assembly with upper contact portions extending upwardly above the upper face with a first distance;*

*a pick up cap mounted upon the upper face without physically engaging any contacts and defining an planar body with an upward top surface thereon; and*

*a moveable fastening device attached to the housing assembly that is pivotable from an open position to a closed positon and defining an opening that exposes the upward top surface of said pick up cap to an exterior in a vertical direction for suction;*

*wherein an undersurface of said planar body is spaced from said upper face with a second distance which is slightly larger than said first distance so as to protectively have said upper contact portion closely hidden under said planar body without damage during handing.*

*47. The assembly as claimed in claim 46, wherein said contacts are arranged in a matrix, and said pick up cap encloses substantially all of said contacts.*

* * * * *

US006905353C2

(12) EX PARTE REEXAMINATION CERTIFICATE (9997th)

United States Patent
Ma et al.

(10) Number: US 6,905,353 C2
(45) Certificate Issued: Jan. 2, 2014

(54) ELECTRICAL CONNECTOR ASSEMBLY WITH PICK UP CAP PROTECTING CONTACTS

(75) Inventors: Hao-Yun Ma, Tu-chen (TW); Ming-Lun Szu, Tu-Chen (TW)

(73) Assignee: Hon Hai Precision Ind. Co., Ltd., Tu-Chen, Taipei Hsien (TW)

Reexamination Request:
No. 90/012,804, Mar. 5, 2013

Reexamination Certificate for:

| | |
|---|---|
| Patent No.: | **6,905,353** |
| Issued: | **Jun. 14, 2005** |
| Appl. No.: | **10/618,147** |
| Filed: | **Jul. 11, 2003** |

Reexamination Certificate C1 6,905,353 issued Aug. 21, 2012

(30) Foreign Application Priority Data

Mar. 7, 2003 (TW) ..... 92203517

(51) Int. Cl.
*H01R 13/52* (2006.01)

(52) U.S. Cl.
USPC ..... 439/135; 439/41; 439/940

(58) Field of Classification Search
None
See application file for complete search history.

(56) References Cited

To view the complete listing of prior art documents cited during the proceeding for Reexamination Control Number 90/012,804, please refer to the USPTO's public Patent Application Information Retrieval (PAIR) system under the Display References tab.

*Primary Examiner* — James Menefee

(57) ABSTRACT

An electrical connector assembly includes an electrical connector (2) and a pick up cap (1) attached onto the connector. The connector includes a generally rectangular housing (21), a clip (24) pivotally engaged to the housing, and a number of electrical contacts (23) received in the housing. The housing includes a cavity (210) formed with a front side (211), a rear side (212) opposite to the front side, and a pair of opposite lateral sides (213) interconnecting the front side and the rear side. The pick up cap includes a planar body (10) with a smooth top surface (100) and a bottom surface thereof. In use, the pick up cap is mounted between the clip and the housing, therefore, it is close to the contacts and covers nearly all the exposed contacts, thereby providing the protection of the contacts.

2

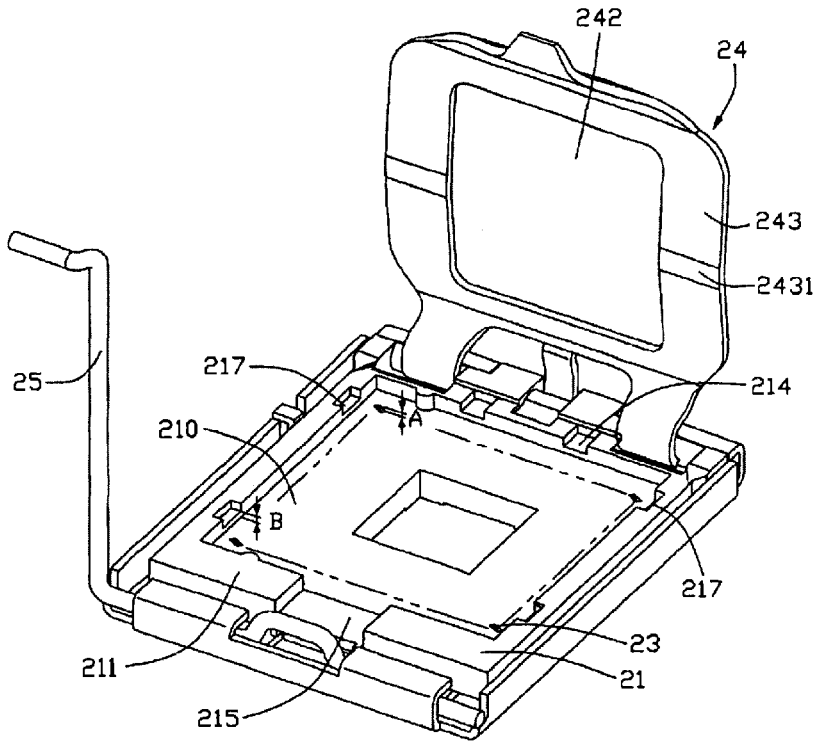

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 1-15, 18-32 and 35-47 is confirmed.

Claims 16 and 33 are determined to be patentable as amended.

Claims 17 and 34, dependent on an amended claim, are determined to be patentable.

New claims 48-117 are added and determined to be patentable.

16. An electrical connector assembly comprising:

an insulative housing assembly defining an upper face thereon, *the housing assembly having a front side, a rear side and lateral sides that cooperatively define a cavity therebetween for receiving an integrated circuit*;

a plurality of contacts disposed in the housing assembly with upper contact portions extending upwardly above the upper face with a first distance; and a pick up cap *disposed in the integrated circuit receiving cavity,* mounted upon the upper face without physically engaging any contacts and defining a planar body with an upward top surface thereon;

wherein an undersurface of said planar body is spaced from said upper face with a second distance which is slightly larger than said first distance so as to protectively have said upper contact portion closely hidden under said planar body without damage during handing.

33. An electrical connector assembly for mounting on a printed circuit board and for coupling a land grid package to said printed circuit board, said electrical connector assembly comprising:

an insulative housing assembly defining an upper face thereon;

a plurality of contacts disposed in the housing assembly with upper contact portions extending upwardly above the upper face with a first distance, the contacts for providing a conduction path between said printed circuit board and said land grid package when said land grid package is installed on said electrical connector assembly; and a pick up cap mounted upon the upper face without physically engaging any contacts and defining [an] *a* planar body with an upward top surface thereon;

wherein an undersurface of said planar body is spaced from said upper face with a second distance which is slightly larger than said first distance so as to protectively have said upper contact portion closely hidden under said planar body without damage during handing.

*48. An electrical connector assembly comprising:*

*an electrical connector comprising an insulative housing, the housing comprising a front side, a rear side and a pair of lateral sides that cooperatively define a cavity therebetween for receiving an integrated circuit, a clip engaged on the housing, and a plurality of electrical contacts received in the housing for contacting the integrated circuit, the contacts protruding from the housing;*

*a pick up cap disposed in the integrated circuit receiving cavity and engaged on an upper surface of the housing without physically engaging any contacts and comprising a planar body with a smooth top surface for being sucked by a vacuum suction device and covering at least a portion of the contacts;*

*wherein the pick up cap is disposed between the housing and the clip; whereby the pick up cap protects the contacts from damage or contamination.*

*49. The electrical connector assembly as claimed in claim 48, wherein the cavity is further bounded by a bottom portion of the housing.*

*50. The electrical connector assembly as claimed in claim 49, wherein the electrical contacts protrude a predetermined height above a bottom portion of the housing in the cavity.*

*51. The electrical connector assembly as claimed in claim 49, wherein a securing recess is defined in the front side, a plurality of spaced rear steps is provided in the rear side, and a plurality of spaced steps is provided in each lateral side.*

*52. The electrical connector assembly as claimed in claim 51, wherein the securing recess, the lateral steps and the rear steps define a same height, and said height is greater than said predetermined height of the contacts protruding above the bottom portion of the housing.*

*53. The electrical connector assembly as claimed in claim 48, wherein the pick up cap comprises a head portion, a plurality of spaced tail portions, and a plurality of spaced lateral portions.*

*54. The electrical connector assembly as claimed in claim 53, wherein a pair of spaced, parallel latch arms depends from the head portion.*

*55. The electrical connector assembly as claimed in claim 48, wherein the clip defines a center window.*

*56. An electrical connector assembly comprising:*

*a housing assembly defining an upper face thereon, the housing assembly comprising a front side, a rear side and a pair of lateral sides that cooperatively define a cavity therebetween for receiving an integrated circuit;*

*a plurality of contacts disposed in the housing assembly for contacting the integrated circuit;*

*a pick up cap disposed in the integrated circuit receiving cavity and mounted upon the upper face without physically engaging any contacts and defining an upward top surface thereon; and*

*a moveable fastening device attached to the housing assembly and defining an opening;*

*wherein the fastening device is moved to either an open position to allow the pick up cap to be downwardly seated upon the housing, or a closed position to cooperate with the housing assembly to sandwich the pick up cap therebetween for holding the pick up cap in position without upward withdrawal under a condition that said opening exposes the upward top surface of said pick up cap to an exterior in a vertical direction for suction.*

*57. The assembly as claimed in claim 56, wherein said housing assembly includes a reinforcement metal frame.*

*58. An electrical connector assembly for mounting on a printed circuit board and for coupling a land grid package to said printed circuit board, said connector assembly comprising:*

*an electrical connector comprising an insulative housing, the housing comprising a front side, a rear side and lateral sides that cooperatively define a cavity therebe-*

*tween for receiving the land grid package, a clip engaged on the housing that is moveable from an open position to a closed position, and a plurality of electrical contacts received in the housing for providing a conduction path between said printed circuit board and said land grid package when said land grid package is installed on said electrical connector assembly, the contacts protruding from the housing;*

*a pick up cap disposed in the land grid package receiving cavity, engaged on an upper face of the housing without physically engaging any contacts and comprising a planar body with a smooth top surface for being sucked by a vacuum suction device and covering at least a portion of the contacts;*

*wherein the pick up cap is disposed between the housing and the clip; whereby the pick up cap protects the contacts from damage or contamination.*

*59. The electrical connector assembly as claimed in claim 58, wherein the cavity is further bounded by a bottom portion of the housing.*

*60. The electrical connector assembly as claimed in claim 59, wherein the electrical contacts protrude a predetermined height above a bottom portion of the housing in the cavity.*

*61. The electrical connector assembly as claimed in claim 59, wherein a securing recess is defined in the front side, a plurality of spaced rear steps is provided in the rear side, and a plurality of spaced steps is provided in each lateral side.*

*62. The electrical connector assembly as claimed in claim 61, wherein the securing recess, the lateral steps and the rear steps define a same height, and said height is greater than said predetermined height of the contacts protruding above the bottom portion of the housing.*

*63. The electrical connector assembly as claimed in claim 58, wherein the pick up cap comprises a head portion, a plurality of spaced tail portions, and a plurality of spaced lateral portions.*

*64. The electrical connector assembly as claimed in claim 63, wherein a pair of spaced, parallel latch arms depends from the head portion.*

*65. The electrical connector assembly as claimed in claim 58, wherein the clip defines a center window.*

*66. An electrical connector assembly for mounting on a printed circuit board and for coupling a land grid package to said printed circuit board, said electrical connector assembly comprising:*

*a housing assembly defining an upper face thereon, the housing assembly comprising a front side, a rear side and a pair of lateral sides that cooperatively define a cavity therebetween for receiving the land grid package;*

*a plurality of contacts disposed in the housing assembly, the contacts for providing a conduction path between said printed circuit board and said land grid package when said land grid package is installed on said electrical connector assembly;*

*a pick up cap disposed in the land grid package receiving cavity, mounted upon the upper face without physically engaging any contacts and defining an upward top surface thereon; and*

*a moveable fastening device attached to the housing assembly and defining an opening;*

*wherein the fastening device is moved to either an open position to allow the pick up cap to be downwardly seated upon the housing, or a closed position to cooperate with the housing assembly to sandwich the pick up cap therebetween for holding the pick up cap in position without upward withdrawal under a condition that said opening exposes the upward top surface of said pick up cap to an exterior in a vertical direction for suction.*

*67. The assembly as claimed in claim 66, wherein said housing assembly includes a reinforcement metal frame.*

*68. An electrical connector assembly for mounting on a printed circuit board and for coupling a land grid package to said printed circuit board, said electrical connector assembly comprising:*

*an insulative housing assembly defining an upper face thereon, the housing assembly comprising a front side, a rear side and a pair of lateral sides that cooperatively define a cavity therebetween for receiving the land grid package;*

*a plurality of contacts disposed in the housing assembly with upper contact portions extending upwardly above the upper face with a first distance, the contacts for providing a conduction path between said printed circuit board and said land grid package when said land grid package is installed on said electrical connector assembly; and*

*a pick up cap disposed in the land grid package receiving cavity, mounted upon the upper face without physically engaging any contacts and defining an planar body with an upward top surface thereon;*

*wherein an undersurface of said planar body is spaced from said upper face with a second distance which is slightly larger than said first distance so as to protectively have said upper contact portion closely hidden under said planar body without damage during handing.*

*69. The assembly as claimed in claim 68, wherein said contacts are arranged in matrix, and said pick up cap encloses substantially all of said contacts.*

*70. An electrical connector assembly for mounting on a printed circuit board and for coupling a land grid package to said printed circuit board, said electrical connector assembly comprising:*

*an insulative housing assembly defining an upper face thereon, the housing assembly comprising a front side, a rear side and a pair of lateral sides that cooperatively define a cavity therebetween for receiving the land grid package;*

*a plurality of contacts disposed in the housing assembly with upper contact portions extending upwardly above the upper face with a first distance, the contacts for providing a conduction path between said printed circuit board and said land grid package when said land grid package is installed on said electrical connector assembly; and*

*a pick up cap disposed in the land grid package receiving cavity, mounted upon the upper face without physically engaging any contacts and defining an planar body with an upward top surface thereon for use with a vacuum suction device when moving said electrical connector assembly to a desired location on said printed circuit board;*

*wherein an undersurface of said planar body is spaced from said upper face with a second distance which is slightly larger than said first distance so as to protectively have said upper contact portion closely hidden under said planar body without damage during handing.*

*71. An electrical connector assembly comprising:*

*an electrical connector comprising an insulative housing, the housing assembly comprising a front side, a rear side and a pair of lateral sides that cooperatively define a cavity therebetween for receiving an integrated circuit, a clip pivotably engaged on the housing that is pivotable from an open position to a closed position and defining*

*an opening, and a plurality of electrical contacts received in the housing for contacting the integrated circuit, the contacts protruding from the housing;*

*a pick up cap disposed in the integrated circuit receiving cavity, engaged on an upper face of the housing without physically engaging any contacts and comprising a planar body with a smooth top surface for being sucked by a vacuum suction device and covering at least a portion of the contacts, the opening in the clip exposing the top surface of the pick up cap to an exterior in a vertical direction for suction;*

*wherein the pick up cap is disposed between the housing and the clip; whereby the pick up cap protects the contacts from damage or contamination.*

*72. The electrical connector assembly as claimed in claim 71, wherein the cavity is further bounded by a bottom portion of the housing.*

*73. The electrical connector assembly as claimed in claim 72, wherein the electrical contacts protrude a predetermined height above a bottom portion of the housing in the cavity.*

*74. The electrical connector assembly as claimed in claim 72, wherein a securing recess is defined in the front side, a plurality of spaced rear steps is provided in the rear side, and a plurality of spaced steps is provided in each lateral side.*

*75. The electrical connector assembly as claimed in claim 74, wherein the securing recess, the lateral steps and the rear steps define a same height, and said height is greater than said predetermined height of the contacts protruding above the bottom portion of the housing.*

*76. The electrical connector assembly as claimed in claim 71, wherein the pick up cap comprises a head portion, a plurality of spaced tail portions, and a plurality of spaced lateral portions.*

*77. The electrical connector assembly as claimed in claim 76, wherein a pair of spaced, parallel latch arms depends from the head portion.*

*78. The electrical connector assembly as claimed in claim 71, wherein the clip defines a center window.*

*79. An electrical connector assembly comprising:*

*a housing assembly defining an upper face thereon, the housing assembly comprising a front side, a rear side and a pair of lateral sides that cooperatively define a cavity therebetween for receiving an integrated circuit; a plurality of contacts disposed in the housing assembly for contacting the integrated circuit;*

*a pick up cap disposed in the integrated circuit receiving cavity, mounted upon the upper face without physically engaging any contacts and defining an upward top surface thereon; and*

*a moveable fastening device attached to the housing assembly and defining an opening;*

*wherein the fastening device is moved to either an open position to allow the pick up cap to be downwardly seated upon the housing, or a closed position to cooperate with the housing assembly to sandwich the pick up cap therebetween for holding the pick up cap in position without upward withdrawal under a condition that said opening exposes the upward top surface of said pick up cap to an exterior in a vertical direction for suction.*

*80. The assembly as claimed in claim 79, wherein said housing assembly includes a reinforcement metal frame.*

*81. An electrical connector assembly comprising:*

*an insulative housing assembly defining an upper face thereon, the housing assembly comprising a front side, a rear side and a pair of lateral sides that cooperatively define a cavity therebetween for receiving an integrated circuit;*

*a plurality of contacts disposed in the housing assembly for contacting the integrated circuit with upper contact portions extending upwardly above the upper face with a first distance;*

*a pick up cap disposed in the integrated circuit receiving cavity, mounted upon the upper face without physically engaging any contacts and defining an planar body with an upward top surface thereon; and*

*a moveable fastening device attached to the housing assembly that is pivotable from an open position to a closed position and defining an opening that exposes the upward top surface of said pick up cap to an exterior in a vertical direction for suction;*

*wherein an undersurface of said planar body is spaced from said upper face with a second distance which is slightly larger than said first distance so as to protectively have said upper contact portion closely hidden under said planar body without damage during handing.*

*82. The assembly as claimed in claim 81, wherein said contacts are arranged in a matrix, and said pick up cap encloses substantially all of said contacts.*

*83. An electrical connector assembly comprising:*

*an electrical connector comprising an insulative housing, the housing comprising a front side, a rear side and a pair of lateral sides, wherein a plurality of spaced rear steps is provided in the rear side, a clip engaged on the housing, and a plurality of electrical contacts received in the housing, the contacts protruding from the housing;*

*a pick up cap engaged on an upper surface of the housing without physically engaging any contacts and comprising a planar body with a smooth top surface for being sucked by a vacuum suction device and covering at least a portion of the contacts;*

*wherein the pick up cap is disposed between the housing and the clip; whereby the pick up cap protects the contacts from damage or contamination.*

*84. The electrical connector assembly as claimed in claim 83, wherein the housing further comprises a bottom portion, and the bottom portion, the front side, the rear side, and the pair of lateral sides cooperatively define a cavity therebetween.*

*85. The electrical connector assembly as claimed in claim 84, wherein the electrical contacts protrude a predetermined height above a bottom portion of the housing in the cavity.*

*86. The electrical connector assembly as claimed in claim 84, wherein a securing recess is defined in the front side, and a plurality of spaced steps is provided in each lateral side.*

*87. The electrical connector assembly as claimed in claim 86, wherein the securing recess, the lateral steps and the rear steps define a same height, and said height is greater than said predetermined height of the contacts protruding above the bottom portion of the housing.*

*88. The electrical connector assembly as claimed in claim 83, wherein the pick up cap comprises a head portion, a plurality of spaced tail portions, and a plurality of spaced lateral portions.*

*89. The electrical connector assembly as claimed in claim 88, wherein a pair of spaced, parallel latch arms depends from the head portion.*

*90. The electrical connector assembly as claimed in claim 83, wherein the clip defines a center window.*

*91. An electrical connector assembly comprising:*

*a housing assembly defining an upper face thereon, the housing comprising a front side, a rear side and a pair of lateral sides, wherein a plurality of spaced rear steps is provided in the rear side;*

*a plurality of contacts disposed in the housing assembly;*

*a pick up cap mounted upon the upper face without physically engaging any contacts and defining an upward top surface thereon; and*

*a moveable fastening device attached to the housing assembly and defining an opening;*

*wherein the fastening device is moved to either an open position to allow the pick up cap to be downwardly seated upon the housing, or a closed position to cooperate with the housing assembly to sandwich the pick up cap therebetween for holding the pick up cap in position without upward withdrawal under a condition that said opening exposes the upward top surface of said pick up cap to an exterior in a vertical direction for suction.*

*92. The assembly as claimed in claim 91, wherein said housing assembly includes a reinforcement metal frame.*

*93. An electrical connector assembly for mounting on a printed circuit board and for coupling a land grid package to said printed circuit board, said connector assembly comprising:*

*an electrical connector comprising an insulative housing, the housing comprising a front side, a rear side and a pair of lateral sides, wherein a plurality of spaced rear steps is provided in the rear side, a clip engaged on the housing that is moveable from an open position to a closed position, and a plurality of electrical contacts received in the housing for providing a conduction path between said printed circuit board and said land grid package when said land grid package is installed on said electrical connector assembly, the contacts protruding from the housing;*

*a pick up cap engaged on an upper face of the housing without physically engaging any contacts comprising a planar body with a smooth top surface for being sucked by a vacuum suction device and covering at least a portion of the contacts;*

*wherein the pick up cap is disposed between the housing and the clip; whereby the pick up cap protects the contacts from damage or contamination.*

*94. The electrical connector assembly as claimed in claim 93, wherein the housing further comprises a bottom portion, and the bottom portion, the front side, the rear side, and the pair of lateral sides cooperatively define a cavity therebetween.*

*95. The electrical connector assembly as claimed in claim 94, wherein the electrical contacts protrude a predetermined height above a bottom portion of the housing in the cavity.*

*96. The electrical connector assembly as claimed in claim 94, wherein a securing recess is defined in the front side, a plurality of spaced rear steps is provided in the rear side, and a plurality of spaced steps is provided in each lateral side.*

*97. The electrical connector assembly as claimed in claim 96, wherein the securing recess, the lateral steps and the rear steps define a same height, and said height is greater than said predetermined height of the contacts protruding above the bottom portion of the housing.*

*98. The electrical connector assembly as claimed in claim 93, wherein the pick up cap comprises a head portion, a plurality of spaced tail portions, and a plurality of spaced lateral portions.*

*99. The electrical connector assembly as claimed in claim 98, wherein a pair of spaced, parallel latch arms depends from the head portion.*

*100. The electrical connector assembly as claimed in claim 93, wherein the clip defines a center window.*

*101. An electrical connector assembly for mounting on a printed circuit board and for coupling a land grid package to said printed circuit board, said electrical connector assembly comprising:*

*a housing assembly defining an upper face thereon, the housing comprising a front side, a rear side and a pair of lateral sides, wherein a plurality of spaced rear steps is provided in the rear side;*

*a plurality of contacts disposed in the housing assembly, the contacts for providing a conduction path between said printed circuit board and said land grid package when said land grid package is installed on said electrical connector assembly;*

*a pick up cap mounted upon the upper face without physically engaging any contacts and defining an upward top surface thereon; and*

*a moveable fastening device attached to the housing assembly and defining an opening;*

*wherein the fastening device is moved to either an open position to allow the pick up cap to be downwardly seated upon the housing, or a closed position to cooperate with the housing assembly to sandwich the pick up cap therebetween for holding the pick up cap in position without upward withdrawal under a condition that said opening exposes the upward top surface of said pick up cap to an exterior in a vertical direction for suction.*

*102. The assembly as claimed in claim 101, wherein said housing assembly includes a reinforcement metal frame.*

*103. An electrical connector assembly for mounting on a printed circuit board and for coupling a land grid package to said printed circuit board, said electrical connector assembly comprising:*

*an insulative housing assembly defining an upper face thereon, the housing comprising a front side, a rear side and a pair of lateral sides, wherein a plurality of spaced rear steps is provided in the rear side;*

*a plurality of contacts disposed in the housing assembly with upper contact portions extending upwardly above the upper face with a first distance, the contacts for providing a conduction path between said printed circuit board and said land grid package when said land grid package is installed on said electrical connector assembly; and*

*a pick up cap mounted upon the upper face without physically engaging any contacts and defining a planar body with an upward top surface thereon;*

*wherein an undersurface of said planar body is spaced from said upper face with a second distance which is slightly larger than said first distance so as to protectively have said upper contact portion closely hidden under said planar body without damage during handing.*

*104. The assembly as claimed in claim 103, wherein said contacts are arranged in matrix, and said pick up cap encloses substantially all of said contacts.*

*105. An electrical connector assembly for mounting on a printed circuit board and for coupling a land grid package to said printed circuit board, said electrical connector assembly comprising:*

*an insulative housing assembly defining an upper face thereon, the housing comprising a front side, a rear side and a pair of lateral sides, wherein a plurality of spaced rear steps is provided in the rear side;*

*a plurality of contacts disposed in the housing assembly with upper contact portions extending upwardly above the upper face with a first distance, the contacts for providing a conduction path between said printed cir-*

*cuit board and said land grid package when said land grid package is installed on said electrical connector assembly; and*

*a pick up cap mounted upon the upper face without physically engaging any contacts and defining an planar body with an upward top surface thereon for use with a vacuum suction device when moving said electrical connector assembly to a desired location on said printed circuit board;*

*wherein an undersurface of said planar body is spaced from said upper face with a second distance which is slightly larger than said first distance so as to protectively have said upper contact portion closely hidden under said planar body without damage during handing.*

*106. An electrical connector assembly comprising:*

*an electrical connector comprising an insulative housing, the housing comprising a front side, a rear side and a pair of lateral sides, wherein a plurality of spaced rear steps is provided in the rear side, a clip pivotably engaged on the housing that is pivotable from an open position to a closed position and defining an opening, and a plurality of electrical contacts received in the housing, the contacts protruding from the housing;*

*a pick up cap engaged on an upper face of the housing without physically engaging any contacts and comprising a planar body with a smooth top surface for being sucked by a vacuum suction device and covering at least a portion of the contacts, the opening in the clip exposing the top surface of the pick up cap to an exterior in a vertical direction for suction;*

*wherein the pick up cap is disposed between the housing and the clip; whereby the pick up cap protects the contacts from damage or contamination.*

*107. The electrical connector assembly as claimed in claim 106, wherein the housing further comprises a bottom portion, and the bottom portion, the front side, the rear side, and the pair of lateral sides cooperatively define a cavity therebetween.*

*108. The electrical connector assembly as claimed in claim 107, wherein the electrical contacts protrude a predetermined height above a bottom portion of the housing in the cavity.*

*109. The electrical connector assembly as claimed in claim 107, wherein a securing recess is defined in the front side, a plurality of spaced rear steps is provided in the rear side, and a plurality of spaced steps is provided in each lateral side.*

*110. The electrical connector assembly as claimed in claim 109, wherein the securing recess, the lateral steps and the rear steps define a same height, and said height is greater than said predetermined height of the contacts protruding above the bottom portion of the housing.*

*111. The electrical connector assembly as claimed in claim 106, wherein the pick up cap comprises a head portion, a plurality of spaced tail portions, and a plurality of spaced lateral portions.*

*112. The electrical connector assembly as claimed in claim 111, wherein a pair of spaced, parallel latch arms depends from the head portion.*

*113. The electrical connector assembly as claimed in claim 106, wherein the clip defines a center window.*

*114. An electrical connector assembly comprising:*

*a housing assembly defining an upper face thereon, the housing comprising a front side, a rear side and a pair of lateral sides, wherein a plurality of spaced rear steps is provided in the rear side; a plurality of contacts disposed in the housing assembly;*

*a pick up cap mounted upon the upper face without physically engaging any contacts and defining an upward top surface thereon; and*

*a moveable fastening device attached to the housing assembly and defining an opening;*

*wherein the fastening device is moved to either an open position to allow the pick up cap to be downwardly seated upon the housing, or a closed position to cooperate with the housing assembly to sandwich the pick up cap therebetween for holding the pick up cap in position without upward withdrawal under a condition that said opening exposes the upward top surface of said pick up cap to an exterior in a vertical direction for suction.*

*115. The assembly as claimed in claim 114, wherein said housing assembly includes a reinforcement metal frame.*

*116. An electrical connector assembly comprising:*

*an insulative housing assembly defining an upper face thereon, the housing comprising a front side, a rear side and a pair of lateral sides, wherein a plurality of spaced rear steps is provided in the rear side;*

*a plurality of contacts disposed in the housing assembly with upper contact portions extending upwardly above the upper face with a first distance;*

*a pick up cap mounted upon the upper face without physically engaging any contacts and defining an planar body with an upward top surface thereon; and*

*a moveable fastening device attached to the housing assembly that is pivotable from an open position to a closed position and defining an opening that exposes the upward top surface of said pick up cap to an exterior in a vertical direction for suction;*

*wherein an undersurface of said planar body is spaced from said upper face with a second distance which is slightly larger than said first distance so as to protectively have said upper contact portion closely hidden under said planar body without damage during handing.*

*117. The assembly as claimed in claim 116, wherein said contacts are arranged in a matrix, and said pick up cap encloses substantially all of said contacts.*

* * * * *

US006905353C3

(12) EX PARTE REEXAMINATION CERTIFICATE (10504th)

United States Patent
Ma et al.

(10) Number: US 6,905,353 C3
(45) Certificate Issued: Feb. 17, 2015

(54) ELECTRICAL CONNECTOR ASSEMBLY WITH PICK UP CAP PROTECTING CONTACTS

(75) Inventors: Hao-Yun Ma, Tu-chen (TW); Ming-Lun Szu, Tu-Chen (TW)

(73) Assignee: Hon Hai Precision Ind. Co., Ltd., Tu-Chen, Taipei Hsien (TW)

Reexamination Request:
No. 90/013,151, Feb. 12, 2014

Reexamination Certificate for:

| | |
|---|---|
| Patent No.: | **6,905,353** |
| Issued: | **Jun. 14, 2005** |
| Appl. No.: | **10/618,147** |
| Filed: | **Jul. 11, 2003** |

Reexamination Certificate C1 6,905,353 issued Aug. 21, 2012

Reexamination Certificate C2 6,905,353 issued Jan. 2, 2014

(30) Foreign Application Priority Data

Mar. 7, 2003 (TW) ..... 92203617 U

(51) Int. Cl.
*H01R 13/52* (2006.01)

(52) U.S. Cl.
USPC ..... 439/135; 439/41; 439/940

(58) Field of Classification Search
None
See application file for complete search history.

(56) References Cited

To view the complete listing of prior art documents cited during the proceeding for Reexamination Control Number 90/013,151, please refer to the USPTO's public Patent Application Information Retrieval (PAIR) system under the Display References tab.

*Primary Examiner* — Linh M Nguyen

(57) ABSTRACT

An electrical connector assembly includes an electrical connector (2) and a pick up cap (1) attached onto the connector. The connector includes a generally rectangular housing (21), a clip (24) pivotally engaged to the housing and a number of electrical contacts (23) received in the housing. The housing includes a cavity (210) formed with a front side (211), a rear side (212) opposite to the front side, and a pair of opposite lateral sides (213)interconnecting the front side and the rear side. The pick up cap includes a planar body (10) with a smooth top surface (100) and a bottom surface thereof. In use, the pick up cap is mounted between the clip and the housing, therefore, it is close to the contacts and covers nearly all the exposed contacts, thereby providing the protection of the contacts.

2

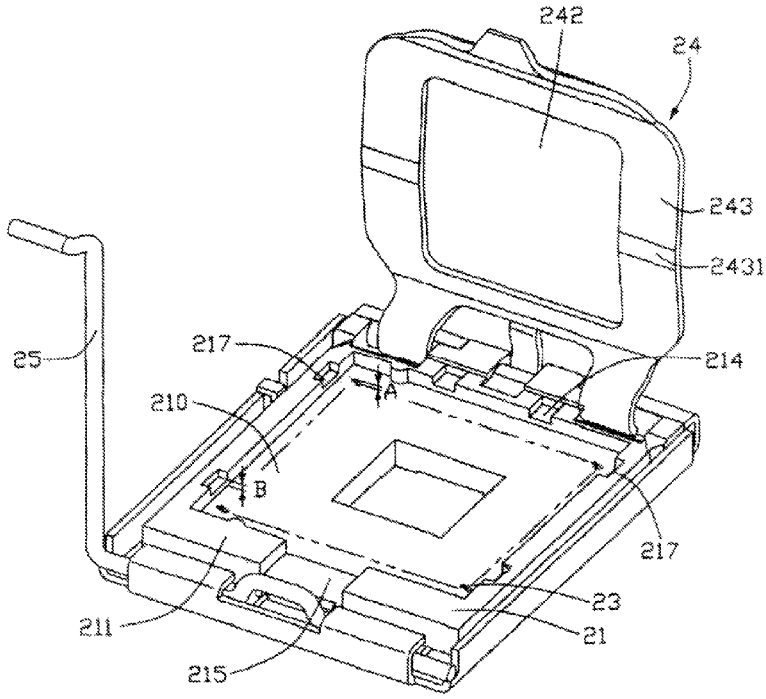

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 16-25, 31-32, 48-67, 71-78 and 93-102 is confirmed.

Claims 1, 9, 14, 26, 33, 35, 36, 44, 46, 68, 70, 79, 81, 83, 91, 103, 105, 106, 114 and 116 are determined to be patentable as amended.

Claims 2-8, 10-13, 15, 27-30, 34, 37-43, 45, 47, 69, 80, 82, 84-90, 92, 104, 107-113, 115 and 117, dependent on an amended claim, are determined to be patentable.

1. An electrical connector assembly comprising:

an electrical connector comprising an insulative housing, a clip engaged on the housing, and a plurality of electrical contacts received in the housing, the contacts protruding from the housing;

a pick up cap engaged on an upper surface of the housing without physically engaging any contacts *or an integrated circuit received in the housing* and comprising a planar body with a smooth top surface for being sucked by a vacuum suction device and covering at least a portion of the contacts;

wherein the pick up cap is disposed between the housing and the clip; whereby the pick up cap protects the contacts from damage or contamination.

9. An electrical connector assembly comprising:

an electrical connector comprising a dielectric housing with an upper face, and a plurality of conductive contacts received therein, the housing comprising a plurality of side walls and a bottom portion cooperatively defining a cavity therebetween; and a pick up cap comprising a planar body with a smooth top surface; wherein the pick up cap is disposed in the cavity and engages with sidewalls of the cavity and the upper face of the housing without physically engaging any contacts *or an integrated circuit received in the cavity*;

whereby the pickup cap provides protection for the contacts, and the side walls of the housing are comprised in a front side, a rear side and a pair of lateral sides of the housing, and a securing recess is defined in the front side, a pair of spaced rear steps is provided in the rear side, and a pair of spaced lateral steps is provided in each lateral side.

14. An electrical connector assembly comprising:

a housing assembly defining an upper face thereon;

a plurality of contacts disposed in the housing assembly;

a pick up cap mounted upon the upper face without physically engaging any contacts *or an integrated circuit* and defining an upward top surface thereon; and a moveable fastening device attached to the housing assembly and defining an opening;

wherein the fastening device is moved to either an open position to allow the pick up cap to be downwardly seated upon the housing, or a closed position to cooperate with the housing assembly to sandwich the pick up cap therebetween for holding the pick up cap in position without upward withdrawal under a condition that said opening exposes the upward top surface of said pick up cap to an exterior in a vertical direction for suction.

26. An electrical connector assembly for mounting on a printed circuit board and for coupling a land grid package to said printed circuit board, said electrical connector assembly comprising:

an electrical connector comprising a dielectric housing, and a plurality of conductive contacts received therein, the conductive contacts for providing a conduction path between said printed circuit board and said land grid package when said land grid package is installed on said electrical connector assembly, the housing comprising a plurality of side walls and a bottom portion cooperatively defining a cavity therebetween; and a pick up cap comprising a planar body with a smooth top surface;

wherein the pick up cap is disposed in the cavity *in place of the land grid package* and engages an upper face of the housing with sidewalls of the cavity without physically engaging any contacts *directly or indirectly through an intervening structure directly coupled to tips of the contacts and the pick up cap*; whereby the pickup cap provides protection for the contacts, and the side walls of the housing are comprised in a front side, a rear side and a pair of lateral sides of the housing, and a securing recess is defined in the front side, a pair of spaced rear steps is provided in the rear side, and a pair of spaced lateral steps is provided in each lateral side.

33. An electrical connector assembly for mounting on a printed circuit board and for coupling a land grid package to said printed circuit board, said electrical connector assembly comprising:

an insulative housing assembly defining [an upper face thereon] *an upward-facing bottom surface and an upward-facing support face located above the bottom surface*;

a plurality of contacts disposed in the housing assembly with upper contact portions extending upwardly above the [upper face with] *upward-facing bottom surface to a level that is* a first distance *from the bottom surface*, the contacts for providing a conduction path between said printed circuit board and said land grid package when said land grid package is installed on said electrical connector assembly; and a pick up cap mounted *in place of the land grid package and* upon the [upper] *upward-facing support* face without physically engaging any contacts and defining a planar body with an upward top surface thereon;

wherein an undersurface of said planar body is spaced from said [upper face with] *upward-facing bottom surface by* a second distance which is slightly larger than said first distance so as to protectively have said upper contact portion closely hidden under said planar body without damage during handing.

35. An electrical connector assembly for mounting on a printed circuit board and for coupling a land grid package to said printed circuit board, said electrical connector assembly comprising:

an insulative housing assembly defining [an upper face thereon] *an upward-facing bottom surface and an upward-facing support face located above the bottom surface*;

a plurality of contacts disposed in the housing assembly with upper contact portions extending upwardly above the [upper face with] *upward-facing bottom surface to a level that is* a first distance *from the bottom surface*, the contacts for providing a conduction path between said printed circuit board and said land grid package when said land grid package is installed on said electrical connector assembly; and a pick up cap mounted *in place of the land grid package and* upon the [upper] *upward-facing support* face without physically engaging any contacts and defining a planar body with an upward top surface thereon for use with a vacuum suction device when moving said electrical connector assembly to a desired location on said printed circuit board;

wherein an undersurface of said planar body is spaced from said [upper face with] *upward-facing bottom surface by* a second distance which is slightly larger than said first distance so as to protectively have said upper contact portion closely hidden under said planar body without damage during handing.

36. An electrical connector assembly comprising:

an electrical connector comprising an insulative housing, a clip pivotably engaged on the housing that is pivotable from an open position to a closed position and defining an opening, and a plurality of electrical contacts received in the housing, the contacts protruding *upward* from *an upward-facing bottom surface of* the housing;

a pick up cap *received in the electrical connector in place of an integrated circuit and* engaged on an upper face of the housing without physically engaging any contacts and comprising a planar body with a smooth top surface for being sucked by a vacuum suction device and covering at least a portion of the contacts, the opening in the clip exposing the top surface of the pick up cap to an exterior in a vertical direction for suction;

wherein the pick up cap is disposed between the housing and the clip; whereby the pick up cap protects the contacts from damage or contamination.

44. An electrical connector assembly comprising:

a housing assembly defining an upper face thereon;

a plurality of contacts disposed in the housing assembly;

a pick up cap mounted upon the upper face without physically engaging any contacts [and] *directly or indirectly through an intervening structure directly coupled to tips of the contacts and the pick up cap, the pick up cap* defining an upward top surface thereon; and a moveable fastening device attached to the housing assembly and defining an opening;

wherein the fastening device is moved to either an open position to allow the pick up cap to be downwardly seated upon the housing, or a closed position to cooperate with the housing assembly to sandwich the pick up cap therebetween for holding the pick up cap in position without upward withdrawal under a condition that said opening exposes the upward top surface of said pick up cap to an exterior in a vertical direction for suction.

46. An electrical connector assembly comprising:

an insulative housing assembly defining [an upper face thereon] *an upward-facing bottom surface and an upward-facing support face located above the bottom surface*;

a plurality of contacts disposed in the housing assembly with upper contact portions extending upwardly above the [upper face with] *upward-facing bottom surface to a level that is* a first distance *from the bottom surface*;

a pick up cap mounted *in place of an integrated circuit and* upon the [upper] *upward-facing support* face without physically engaging any contacts and defining a planar body with an upward top surface thereon; and a moveable fastening device attached to the housing assembly that is pivotable from an open position to a closed position and defining an opening that exposes the upward top surface of said pick up cap to an exterior in a vertical direction for suction;

wherein an undersurface of said planar body is spaced from said [upper face with] *upward-facing bottom surface by* a second distance which is slightly larger than said first distance so as to protectively have said upper contact portion closely hidden under said planar body without damage during handing.

68. An electrical connector assembly for mounting on a printed circuit board and for coupling a land grid package to said printed circuit board, said electrical connector assembly comprising:

an insulative housing assembly defining [an upper face thereon] *an upward-facing bottom surface and an upward-facing support face located above the bottom surface*, the housing assembly comprising a front side, a rear side and a pair of lateral sides that cooperatively define a cavity therebetween for receiving the land grid package;

a plurality of contacts disposed in the housing assembly with upper contact portions extending upwardly above the [upper face with] *upward-facing bottom surface to a level that is* a first distance *from the bottom surface*, the contacts for providing a conduction path between said printed circuit board and said land grid package when said land grid package is installed on said electrical connector assembly; and a pick up cap disposed in the land grid package receiving cavity *in place of the land grid package*, mounted upon the [upper] *upward-facing support* face without physically engaging any contacts and defining [an] *a* planar body with an upward top surface thereon;

wherein an undersurface of said planar body is spaced from said [upper face with] *upward-facing bottom surface by* a second distance which is slightly larger than said first distance so as to protectively have said upper contact portion closely hidden under said planar body without damage during handing.

70. An electrical connector assembly for mounting on a printed circuit board and for coupling a land grid package to said printed circuit board, said electrical connector assembly comprising:

an insulative housing assembly defining [an upper face thereon] *an upward-facing bottom surface and an upward-facing support face located above the bottom surface*, the housing assembly comprising a front side, a rear side and a pair of lateral sides that cooperatively define a cavity therebetween for receiving the land grid package;

a plurality of contacts disposed in the housing assembly with upper contact portions extending upwardly above the [upper face with] *upward-facing bottom surface to a level that is* a first distance *from the bottom surface*, the contacts for providing a conduction path between said printed circuit board and said land grid package when said land grid package is installed on said electrical connector assembly; and a pick up cap disposed in the land grid package receiving cavity *in place of the land grid package*, mounted upon the [upper] *upward-facing support* face without physically engaging any contacts and defining [an] *a* planar body with an upward top surface thereon for use with a vacuum suction device when moving said electrical connector assembly to a desired location on said printed circuit board;

wherein an undersurface of said planar body is spaced from said [upper face with] *upward-facing bottom surface by* a second distance which is slightly larger than said first distance so as to protectively have said upper contact portion closely hidden under said planar body without damage during handing.

79. An electrical connector assembly comprising:

a housing assembly defining an [upper] *upward-facing bottom surface and an upward-facing support* face [thereon , the housing assembly comprising a front side, a rear side and a pair of lateral sides that cooperatively define a cavity therebetween for receiving an integrated circuit] *located above the bottom surface*;

a plurality of contacts disposed in the housing assembly [for contacting the integrated circuit] *and projecting upward from the upward-facing bottom surface*;

a pick up cap [disposed in the integrated circuit receiving cavity,] mounted *in the housing in place of an integrated circuit and mounted* upon the [upper] *upward-facing support* face without physically engaging any contacts[and] , *the pick up cap* defining an upward top surface thereon; [and]

a moveable fastening device attached to the housing assembly and defining an opening;

wherein the fastening device is moved to either an open position to allow the pick up cap to be downwardly seated upon the housing, or a closed position to cooperate with the housing assembly to sandwich the pick up cap therebetween for holding the pick up cap in position without upward withdrawal under a condition that said; *and*

*the* opening [exposes] *in the fastening device exposing* the upward top surface of said pick up cap to an exterior in a vertical direction for suction.

81. An electrical connector assembly comprising:

an insulative housing assembly defining [an upper face thereon] *an upward-facing bottom surface and an upward-facing support face located above the bottom surface*, the housing assembly comprising a front side, a rear side and a pair of lateral sides that cooperatively define a cavity therebetween for receiving an integrated circuit;

a plurality of contacts for contacting the integrated circuit disposed in the housing assembly with upper contact portions extending upwardly above the [upper face with] *upward-facing bottom surface to a level that is* a first distance *from the bottom surface*;

a pick up cap disposed in the integrated circuit receiving cavity *in place of the integrated circuit*, mounted upon the [upper] *upward-facing support* face without physically engaging any contacts and defining a planar body with an upward top surface thereon; and a moveable fastening device attached to the housing assembly that is pivotable from an open position to a closed position and defining an opening that exposes the upward top surface of said pick up cap to an exterior in a vertical direction for suction;

wherein an undersurface of said planar body is spaced from said [upper face with] *upward-facing bottom surface by* a second distance which is slightly larger than said first distance so as to protectively have said upper contact portion closely hidden under said planar body without damage during handing.

83. An electrical connector assembly comprising:

an electrical connector comprising an insulative housing, the housing comprising a front side, a rear side and a pair of lateral sides, wherein a plurality of spaced rear steps is provided in the rear side, a clip engaged on the housing, and a plurality of electrical contacts received in the housing, the contacts protruding *upward* from *an upward-facing bottom surface of* the housing;

a pick up cap *received in the electrical connector in place of an integrated circuit and* engaged on an upper surface of the housing without physically engaging any contacts and comprising a planar body with a smooth top surface for being sucked by a vacuum suction device and covering at least a portion of the contacts;

wherein the pick up cap is disposed between the housing and the clip; whereby the pick up cap protects the contacts from damage or contamination.

91. An electrical connector assembly comprising:

a housing assembly defining an upper face thereon, the housing comprising a front side, a rear side and a pair of lateral sides, wherein a plurality of spaced rear steps is provided in the rear side;

a plurality of contacts disposed in the housing assembly;

a pick up cap mounted upon the upper face without physically engaging any contacts *or an integrated circuit* and defining an upward top surface thereon; and a moveable fastening device attached to the housing assembly and defining an opening;

wherein the fastening device is moved to either an open position to allow the pick up cap to be downwardly seated upon the housing, or a closed position to cooperate with the housing assembly to sandwich the pick up cap therebetween for holding the pick up cap in position without upward withdrawal under a condition that said opening exposes the upward top surface of said pick up cap to an exterior in a vertical direction for suction.

103. An electrical connector assembly for mounting on a printed circuit board and for coupling a land grid package to said printed circuit board, said electrical connector assembly comprising:

an insulative housing assembly defining [an upper face thereon] *an upward-facing bottom surface and an upward-facing support face located above the bottom surface*, the housing *assembly* comprising a front side, a rear side and a pair of lateral sides, wherein a plurality of spaced rear steps is provided in the rear side;

a plurality of contacts disposed in the housing assembly with upper contact portions extending upwardly above the [upper face with] *upward-facing bottom surface to a level that is* a first distance *from the bottom surface*, the contacts for providing a conduction path between said printed circuit board and said land grid package when said land grid package is installed on said electrical connector assembly; and a pick up cap mounted *in place of the land grid package and* upon the [upper] *upward-facing support* face without physically engaging any contacts and defining a planar body with an upward top surface thereon;

wherein an undersurface of said planar body is spaced from said [upper face with] *upward-facing bottom surface by* a second distance which is slightly larger than said first distance so as to protectively have said upper contact portion closely hidden under said planar body without damage during handing.

105. An electrical connector assembly for mounting on a printed circuit board and for coupling a land grid package to said printed circuit board, said electrical connector assembly comprising:

an insulative housing assembly defining [an upper face thereon] *an upward-facing bottom surface and an upward-facing support face located above the bottom surface*, the housing *assembly* comprising a front side, a rear side and a pair of lateral sides, wherein a plurality of spaced rear steps is provided in the rear side;

a plurality of contacts disposed in the housing assembly with upper contact portions extending upwardly above the [upper face with] *upward-facing bottom surface to a level that is* a first distance *from the bottom surface*, the contacts for providing a conduction path between said printed circuit board and said land grid package when said land grid package is installed on said electrical connector assembly; and a pick up cap mounted *in place of the land grid package and* upon the [upper] *upward-facing support* face without physically engaging any contacts and defining a planar body with an upward top surface thereon for use with a vacuum suction device when moving said electrical connector assembly to a desired location on said printed circuit board;

wherein an undersurface of said planar body is spaced from said [upper face with] *upward-facing bottom surface by* a second distance which is slightly larger than said first distance so as to protectively have said upper contact portion closely hidden under said planar body without damage during handing.

106. An electrical connector assembly comprising:

an electrical connector comprising an insulative housing, the housing comprising a front side, a rear side and a pair of lateral sides, wherein a plurality of spaced rear steps is provided in the rear side, a clip pivotably engaged on the housing that is pivotable from an open position to a closed position and defining an opening, and a plurality of electrical contacts received in the housing, the contacts protruding *upward* from *an upward-facing bottom surface of* the housing;

a pick up cap *received in the electrical connector in place of an integrated circuit and* engaged on an upper face of the housing without physically engaging any contacts and comprising a planar body with a smooth top surface for being sucked by a vacuum suction device and covering at least a portion of the contacts, the opening in the clip exposing the top surface of the pick up cap to an exterior in a vertical direction for suction;

wherein the pick up cap is disposed between the housing and the clip; whereby the pick up cap protects the contacts from damage or contamination.

114. An electrical connector assembly comprising:

a housing assembly defining an [upper] *upward-facing bottom surface and an upward-facing support* face [thereon , the housing assembly comprising a front side, a rear side and a pair of lateral sides that cooperatively define a cavity therebetween for receiving an integrated circuit] *located above the bottom surface*;

a plurality of contacts disposed in the housing assembly *and projecting upward from the upward-facing bottom surface*;

a pick up cap mounted *in the housing in place of an integrated circuit and mounted* upon the [upper] *upward-facing support* face without physically engaging any contacts and *without intervening structure directly coupled to tips of the contacts and the pick up cap, the pick up cap* defining an upward top surface thereon; [and]

a moveable fastening device *that is rotatably* attached to the housing assembly [and defining an opening] *for rotating between a vertically-oriented open position and a horizontally-oriented closed position*;

wherein *the fastening device is configured such that rotating* the fastening device [is moved to either an] to *the* open position [to allow] *allows* the pick up cap to be downwardly seated upon the housing [, or a] *and rotating the fastening device to the* closed position *allows the fastening device* to cooperate with the housing assembly to sandwich the pick up cap therebetween for holding the pick up cap in position without upward withdrawal [under a condition that said]*; and*

*an* opening *defined in the fastening device that* exposes the upward top surface of said pick up cap to an exterior in a vertical direction for suction.

116. An electrical connector assembly comprising:

an insulative housing assembly defining [an upper face thereon] *an upward-facing bottom surface and an upward-facing support face located above the bottom surface*, the housing *assembly* comprising a front side, a rear side and a pair of lateral sides, wherein a plurality of spaced rear steps is provided in the rear side;

a plurality of contacts disposed in the housing assembly with upper contact portions extending upwardly above the [upper face with] *upward-facing bottom surface to a level that is* a first distance *from the bottom surface*;

a pick up cap mounted *in place of an integrated circuit and* upon the [upper] *upward-facing support* face without physically engaging any contacts *directly or indirectly through an intervening structure directly coupled to the upper contact portions and the pick up cap* and defining a planar body with an upward top surface thereon; and a moveable fastening device attached to the housing assembly that is pivotable from an open position to a closed position and defining an opening that exposes the upward top surface of said pick up cap to an exterior in a vertical direction for suction;

wherein an undersurface of said planar body is spaced from said [upper face with] *upward-facing bottom surface by* a second distance which is slightly larger than said first distance so as to protectively have said upper contact portion closely hidden under said planar body without damage during handing.

* * * * *